US005122261A

United States Patent [19]

Hollingsworth

[11] Patent Number: 5,122,261

[45] Date of Patent: Jun. 16, 1992

[54] CONCENTRATION OF MINERALS

[76] Inventor: Clinton A. Hollingsworth, 2025 Sylvester Rd., Apt. #207, Lakeland, Fla. 33803

[21] Appl. No.: 588,620

[22] Filed: Sep. 26, 1990

[51] Int. Cl.[5] ..... B03D 1/24

[52] U.S. Cl. ..... 209/170; 261/123; 261/124; 209/169

[58] Field of Search ..... 209/170, 169; 210/221.2; 261/122, 124, 123

[56] References Cited

U.S. PATENT DOCUMENTS

| | | | |
|---|---|---|---|
| 1,407,258 | 2/1922 | Connors | 209/170 |
| 2,141,862 | 12/1938 | Holl | 209/169 |
| 2,758,714 | 8/1956 | Hollingsworth | 209/170 |
| 3,298,519 | 1/1967 | Hollingsworth | 209/170 |
| 3,371,779 | 3/1968 | Hollingsworth | 209/170 |
| 3,393,803 | 7/1968 | Daman | 209/170 |
| 4,066,540 | 1/1978 | Wada | 209/170 |
| 4,287,054 | 9/1981 | Hollingsworth | 209/170 |
| 4,431,531 | 2/1984 | Hollingsworth | 209/170 |

FOREIGN PATENT DOCUMENTS

| | | | |
|---|---|---|---|
| 60-35094 | 2/1985 | Japan | 209/170 |

OTHER PUBLICATIONS

"Column Flotation" by Finche & Dobby Pub. 1990 Rice Univ. Houston, Tex. pp. 59, 60, 65, 72, 73, 116, 124, 129, 131 and 132.

*Primary Examiner*—Stanley S. Silverman
*Assistant Examiner*—Thomas M. Lithgow
*Attorney, Agent, or Firm*—Low and Low

[57] ABSTRACT

The invention relates to a flotation column including a plurality of controlled recycle chambers intentionally introduced into the column to cause the non-float fraction or gangue to drop down in the main float stream while the desired float fraction travels in the opposite direction by recycling to continually mix the pulp while coursing through the column. Recycle zones are positioned on the periphery of the main passage or flotation zone within chambers located in series along the column. A portion of the slurry is drawn into a recycle zone where it passes downwardly to return to the flotation zone or the main passage through the column to again be swept through the column.

14 Claims, 3 Drawing Sheets

CONCENTRATION OF MINERALS

BACKGROUND OF THE INVENTION

1. Field of the Invention

The present invention relates to a process and apparatus for beneficiation of minerals through froth flotation and more particularly to improvements for increasing the efficiency of column type flotation operations wherein impurities are separated from minerals and other floatable materials.

2. Description of the Prior Art

Commercially valuable minerals, for example, metal sulfides, apatitic phosphates and the like, are commonly found in nature mixed with relatively large quantities of unwanted gangue materials, and as a consequence it is usually necessary to beneficiate the ores in order to concentrate the mineral content. Mixtures of finely divided mineral particles and finely divided gangue particles can be separated and a mineral concentrate obtained therefrom by well known froth flotation techniques. Broadly speaking, froth flotation involves conditioning an aqueous slurry or pulp of the mixture of mineral and gangue particles with one or more flotation reagents which will promote flotation of either the mineral or the gangue constituents of the pulp when the pulp is aerated. The conditioned pulp is aerated by introducing into the pulp a plurality of minute air bubbles which tend to become attached either to the mineral particles or to the gangue particles of the pulp, thereby causing these particles to rise to the surface of the body of pulp and form a float fraction which overflows or is withdrawn from the flotation apparatus.

In conventional sub-aeration flotation machines the aqueous pulp ordinarily is aerated by means of a mechanical impeller-type agitator and aerator which extends into the body of pulp and which disperses minute bubbles of air throughout the body of pulp by vigorous mechanical agitation of the pulp. The feed mixture of particulate material is normally introduced into one end of a bank of flotation machines, and the agitated pulp travels or progresses in an essentially horizontal direction to the pulp discharge at the opposite end of the bank of machines. The agitated pulp, of course, becomes increasingly depleted in floatable mineral values as the pulp progresses from the feed end to the discharge end of the bank of machines. A bank of four to six mechanical cells are normally used for this purpose. Flotation machines which employ vigorous agitation of the pulp to effect aeration thereof posses serious disadvantages when employed in connection with pulps that contain difficult to float particles which, because of the vigorous agitation, may not become attached to a sufficient number of air bubbles to float the particles or which may be dislodged from the froth column lying on top of the agitated body of pulp. Moreover, when used in connection with pulps containing soft or friable particles, vigorous mechanical agitation of the pulp tends to produce slimes which in many cases adversely affect the efficiency of flotation otherwise obtainable.

To overcome these and other disadvantages of mechanically agitated flotation machines, aerating air has been introduced directly into a relatively quiescent body of aqueous pulp by means of air diffusers or aerators which are immersed in or are in direct contact with the pulp. Such flotation apparatus are commonly referred to as pneumatic flotation machines and as with mechanical cells, the flow is essentially horizontal but sometimes they have some slope. These machines have been found to be efficient when used with ores that do not require vigorous agitation in order to prevent too rapid settling out of the solid particulate matter in the aqueous pulp. They are particularly useful when the pulp being treated tends to form harmful slimes when subjected to vigorous agitation. The air diffusers or aerators of conventional pneumatic flotation machines ordinarily comprise a porous material (for example, heavy canvas, sintered metal powder structures, and the like) through which minute air bubbles are directly introduced into the aqueous pulp. As a consequence, conventional pneumatic flotation machines are subject to a very troublesome problem caused by the tendency of the air diffusers immersed in or in contact with the pulp to become covered with a tenacious coating composed of oily flotation reagents and fine particles of minerals and gangue which clogs the minute openings frustrating air flow.

Contrasted with the use of pneumatic and mechanical flotation cells are the conventional column flotation cells in which the flow is vertical instead of horizontal. Column type flotation cells and processes are described, for example, in Hollingsworth, U.S. Pat. Nos. 3,298,519 and 4,431,531, and Hollingsworth et al, U.S. Pat. Nos. 2,758,714, 3,298,519, 3,371,779 and 4,287,054.

A symposium was held on Column Flotation Jan. 25–28, 1988 at a Mining Engineers Meeting in Phoenix, Ariz. This resulted in the issuing of a book entitled "Column Flotation" in which K. V. S. Sastry was the editor. This book covers essentially all of the column development for the period 1962 through 1987.

Hollingsworth began the development of column flotation in 1952 and has continued to make developments in this field. The initial work resulted in the issuance of U.S. Pat. No. 2,758,714, dated Aug. 14, 1956. This patent describes column flotation equipment having a flared section at the top of the column which slows down the movement of the pulp and permits non-floatable material trapped in the rising pulp to drop out before it overflows the weir. The material that dropped out could be carried through a side chamber either to the bottom or midway the depth of the column. In doing so, however, some floatables would be carried along with the non-floatables and, although a grade (quality) improvement was achieved there was some reduction in recovery, but it does not overcome some faults of conventional columns. The single recycle described in U.S. Pat. No. 2,758,714 was found to result in the loss of an unacceptable amount of floatable material.

In conventional flotation columns uniform air distribution across the entire cross sectional area of the column is required to obtain good results. Should one area receive less air than other areas the downward flow in this area would greatly increase thus carrying floatable material to the bottom and out the underflow, thus reducing recovery. Uneven air distribution is probably the most serious problem encountered in conventional columns.

In prior art column flotation apparatus, efforts have been made to create a true counter-current system in which air bubbles rise straight up and pulp travels straight downward until floatable materials become attached to the rising bubbles and subsequently rise to the top of the column where they are discharged as an overflow while the non-floatables travel downward to the bottom where they are discharged as an underflow. The top overflow is usually the concentrate product and the bottom underflow is usually the waste tailings, but in some cases they can be the reverse. Recycle conditions within the column are avoided since they disrupt the uniformity of linear aeration across the cross-sectional area and tend to carry the floatable materials to the bottom where they are likely to be lost in the underflow.

"Column Flotation", a printed publication by J. A. Finch and G. S. Dobby, copyrighted 1990, discusses the undesirability of having mixing conditions within the flotation column. This publication exemplifies the past and current view which teaches away from the present invention. The authors state that "mixing has a detrimental effect upon recovery [and that] mixing also has a detrimental effect upon separation." Page 59. On page 65 the authors state that ". . . a small vertical misalignment in the column causes a large increase in axial mixing [and that] the effect of alignment has not been studied in large columns." The book does state that, ". . . circuits, particularly with recycle, have inherent advantages in terms of separation efficiency." Page 116. However, recycle in this context refers to either the drop of particles from the froth zone to the flotation zone or to the running off of a product from one column followed by a recycle through a second separation device Pp. 103-106, 132 and 134. The authors do not even suggest, but rather teach away from the concept of recycle within the flotation zone of an individual flotation column.

In most mineral beneficiation operations, it is customary to have what is known as rougher and cleaner circuits of flotation devices. In the rougher circuit a tailings product and a rougher concentrate product are produced. The rougher concentrate is then sent to one or more cleaner circuits where it is cleaned to produce a high grade final concentrate that is suitable to be marketed and a middlings product that is recycled back to the head of the circuit. In some cases the underflow tailings product is sent to a scavenger circuit to recover additional mineral values. The circuits involved can either be columns, mechanical cells or air cells and in some cases combinations of several devices.

The present invention has many advantages over conventional columns and mechanical cells, the most important of which is high recovery and high grade in a single column, thus, in many operations this completely eliminates the need for both rougher and cleaner circuits, greatly reducing both capital and operating costs.

SUMMARY OF THE INVENTION

This invention provides a new column flotation process and apparatus for separating mixtures of relatively floatable and relatively non-floatable particles permitting sharper separation of floatables from non-floatables than possible in previous columns or mechanical flotation cells. Flotation conditions in the process and apparatus of this invention are so controlled that for many minerals a final concentrate and a final tailings are both produced in a single column. Contrasted with prior art attempts to avoid non-linear flow in the column this invention involves a plurality of controlled recycle chambers intentionally introduced into the column where the fluids are recycled to continually mix air with pulp while coursing through the column. This is the opposite of what is strived for in prior art flotation columns as presented in the prior art. Recycle zones are positioned on the periphery of the main passage or flotation zone within chambers located in series along the column. A portion of the slurry is drawn into a recycle zone where it passes downwardly to return to a flotation zone or the main passage through the column to again be swept upwardly through the column.

One embodiment of this invention involves the use of disengaging chambers between the recycle chambers to slow the movement of the pulp. Disengaging chambers accentuate the dropout of non-floatable materials so that such materials can be sent to a lower stage in the column. Disengaging baffles may be set at the recycle zone exits where recycle streams re-enter the column to further separate non-floatables from floatables. Another embodiment is the use of disengaging baffles at the exit of the recycle chambers Baffles further separate non-floatables from floatables. These baffles can be in the form of vertical or horizontal bars or a perforated plate. Another embodiment involves the use of shields to improve air distribution over the aerators and to protect the aerators from reagents and materials that could plug them.

DETAILED DESCRIPTION OF THE DRAWINGS

Figure 1:
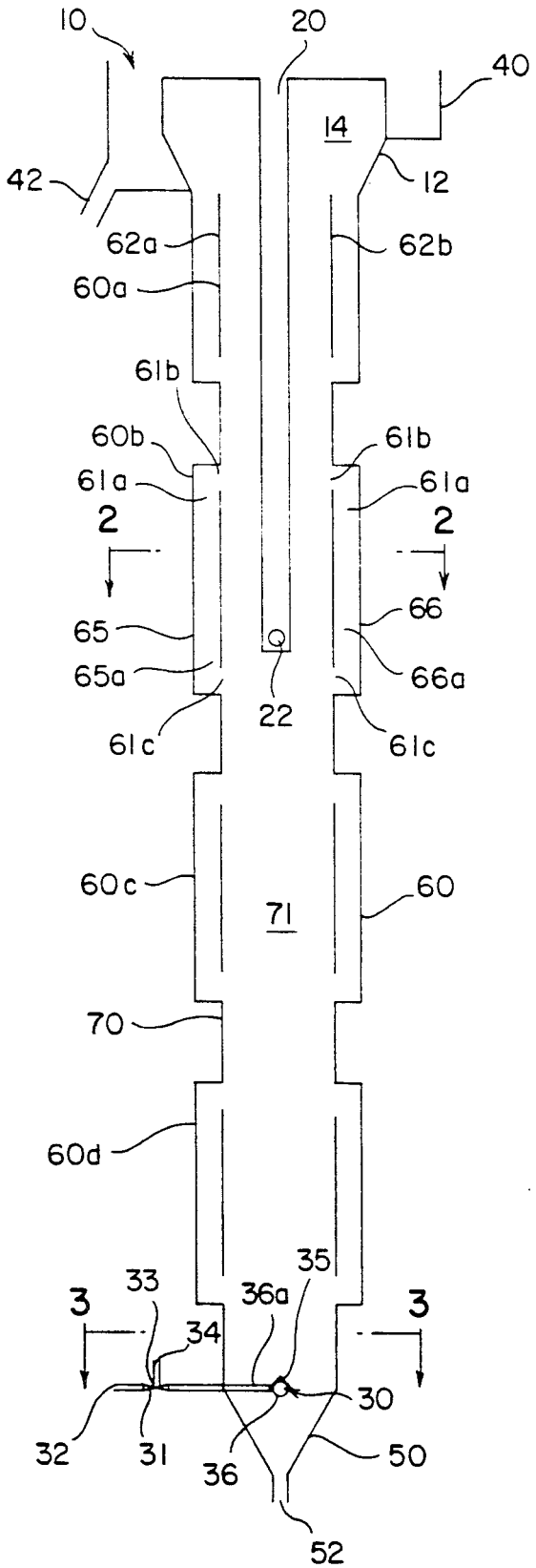
FIG. 1 is a schematic elevational view of the laboratory pilot plant flotation column to test the process of this invention.

Referring now to FIG. 1, the present invention generally includes a flotation column 10, a feed line 20, an aerator 30, an overflow basin 40, and an underflow section 50. The flotation column 10 of this invention includes a plurality of recycle or recirculation chambers 60 oriented adjacent to, and in fluid communication with conventional column sections 70 (a conventional flotation column does not include any recycle chambers 60 and thus does not encourage the mixing of pulp and air) attached in sequence to provide a longitudinal passageway 71 along the length of the column 10.

The pulp which contains a mixture of mineral particles and gangue particles is introduced to the flotation column 10 through feeder line 20. Feeder line 20 may simply be a tube or any other suitable line for the conveyance of pulp. The lower end of feeder line 20 includes an orifice 22 through which the pulp is introduced into the flotation column 10.

The lower end of the feeder line 20 may be located at various depths within the flotation column 10 to vary the grade and recovery of the flotation column 10. Feed is normally introduced at a depth approximately midway into the flotation column 10 to produce a good grade and good recovery. However if emphasis is placed upon a high grade, the lower end of the feed line 20 can be placed below the midway point for the introduction of feed. If emphasis is placed on a high recovery rate, the lower end of the feed line 20 can be located at a depth above the midway point for the introduction of feed. Feed can also be introduced through the sides of the flotation column 10.

Aeration of the column 10 is not limited to any particular type of aerator 30. For example, aeration can be achieved via a constriction compartment 39 (FIGS. 4 and 7), air diffusers or spargers 36, a mechanical aerator 37, etc. depending upon the industrial application. If a mechanical aerator 37 is used, it is sometimes desirable to have a perforated plate above it to reduce turbulence. Fine bubbles can also be generated outside of the column 10 and then fed to the column 10. In some instances a gas other than air may be used for aeration. For example, nitrogen may be used for some sulfide ores if they are subject to oxidation.

Figure 4:
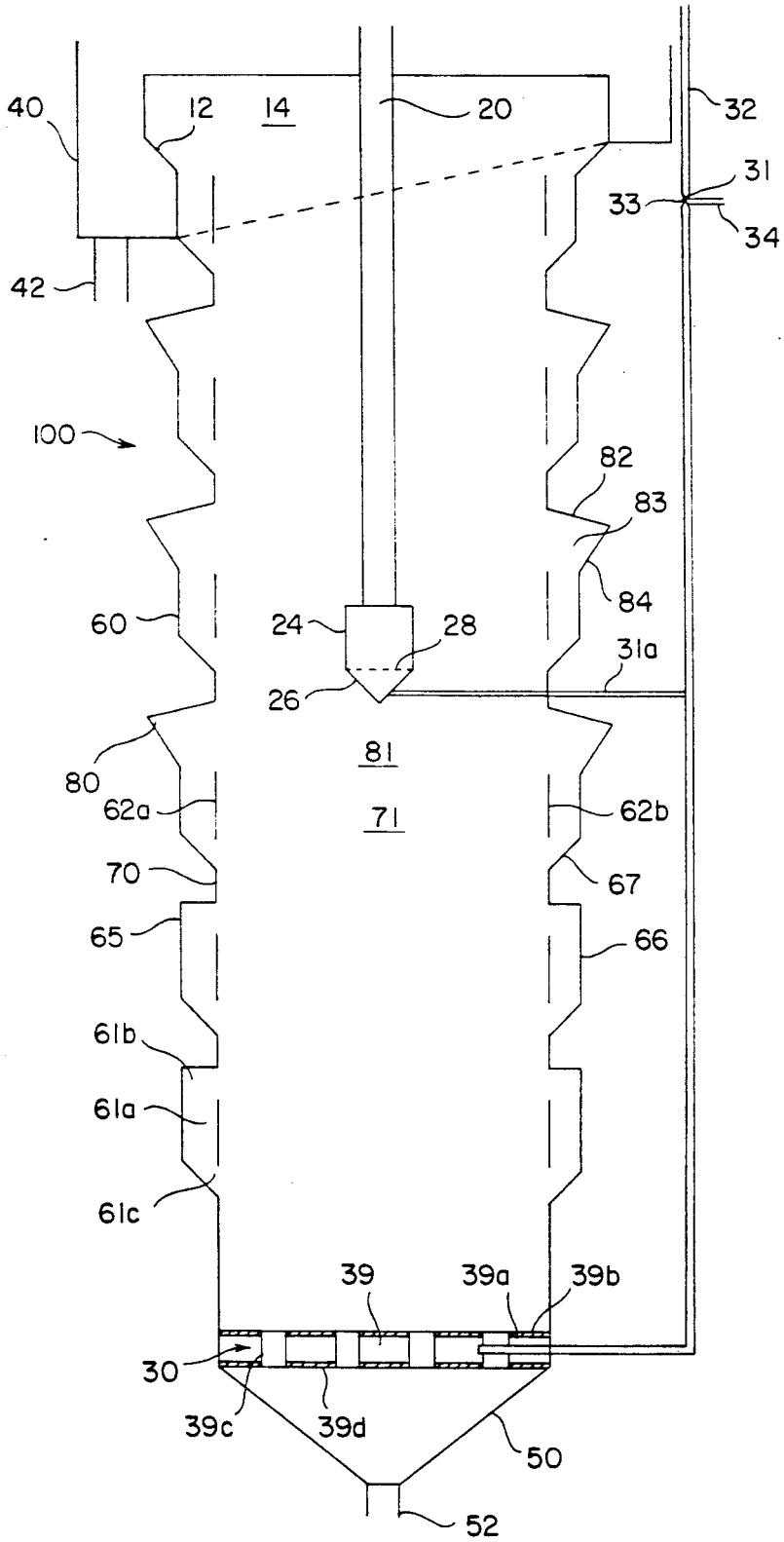
FIG. 4 is a schematic elevational view of a preferred embodiment of the invention described herein.

One of the preferred methods of aeration is the use of eductors 31 to aspirate air into a constriction compartment 39 (FIGS. 4 and 7) using water as the driving force as shown in FIG. 4 and described in U.S. Pat. Nos. 4,431,531 and 3,371,779 which are incorporated herein for all purposes. Aspirated air/water from, for example, an eductor 31 can also be introduced into one or more perforated air distribution tubes 36 in lieu of a constriction compartment 39.

Figure 3:
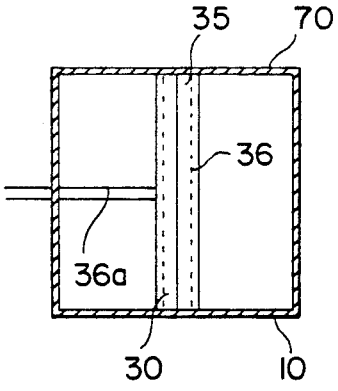
FIG. 3 is a schematic cross-section view of the column of FIG. 1 along lines 3—3.

In FIG. 1, aerator 30 is located at the lower end of flotation column 10. However, additional levels and forms of aeration may be located within the flotation column 10. Eductor 31 as shown includes a running water line 32 which sucks in air forming a venturi 33. Air introduced through air line 34 is normally atmospheric air. Referring to FIGS. 1 and 3, the aspirated mixture is then run through line **36*a* to a pipe 36 disposed within the lower end of flotation column 10. Pipe 36 contains multiple holes (not shown), normally ranging in size from ⅛th inch to 5/16ths inch in diameter, arranged around the portion of the pipe disposed within the flotation column 10 to enhance the uniformity of distribution of the aspirated mixture introduced into the flotation column 10. An inverted V-shaped shield 35 is attached to flotation column 10 over pipe 36 to deflect the aspirated mixture and to protect pipe 36 from reagents and materials that could plug them. Such deflection further enhances the uniformity of distribution of the aspirated mixture V-shaped shield 35 is optional (for example, it is not used in column 200 shown in FIG. 5**) and may be constructed in other shapes.

The eductor method and apparatus for aerating the flotation column 10 is particularly desirable if the percent solids of the feed into the column 10 are fifty percent or higher because water used not only aspirates air into the column 10 thus eliminating the need for a compressor, but water provides needed dilution and keeps the pulp fluidized. On the other hand, if the percent solids is less than 50%, compressed air can be used as the driving force to aspirate a small amount of water into the system. Although the eductor method generates small bubbles, it is customary to add a surfactant (frother) to the water to create even finer bubbles as taught in U.S. Pat. No. 3,371,779 to Hollingsworth et al.

Another type of aerator 30 which may be used and installed like pipe 36 when there is not an aspirated mixture running into the column is a porous diffuser (not shown) for generating fine bubbles. Some examples of materials which can be used for porous diffusers include the ordinary garden soil soaker material found at any hardware store, porous metal, ceramic, plastic, perforated rubber tubing, etc.

The upper end of flotation column 10 preferably includes a flared section 12 as is well known in the art to slow the ascent of the pulp near the upper end in a froth or cleaner zone 14 of the flotation column 10 allowing better separation of non-floatable particles. An overflow basin 40 is attached around the upper end of flotation column 10 to catch the overflow of froth emerging from flotation column 10 created by the rise of a float fraction containing floatable particles. The overflow froth located in overflow basin 40 is drained through outlet 42 for handling in ways well known in the art.

The lower end of flotation column 10 includes an underflow section 50. Underflow section 50 is preferably tapered to the outlet 52 to encourage the descent of the non-float fraction containing unfloated particles toward outlet 52. The underflow is drained from underflow section 50 through outlet 52.

Flotation column 10 generally includes recycle chambers 60, partitions 62 and conventional column sections 70. FIG. 1 illustrates the invention depicting schematically the test unit for this invention. Four stages of recycle **60*a*, 60*b*, 60*c* and 60*d* are shown, but almost any number can be used as determined by the separation required. Normally four to ten recycle chambers are used depending on the application. It is an advantage to the practice that each recycle chamber 60** may be made by modular construction and removed or added by simply disconnecting a fastener such as bolts, for example.

Figure 2:
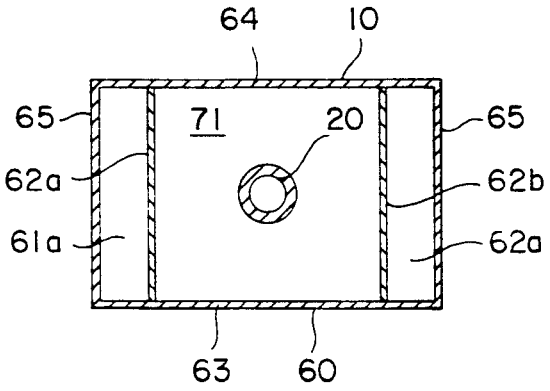
FIG. 2 is a schematic cross-section view of the column of FIG. 1 along lines 2—2.

Referring to FIGS. 1 and 2, partitions **62*a* and 62*b* are attached to two opposing walls 63 and 64 of recycle chambers 60. Feed line 20 is preferably centrally located within flotation column 10. The regions on the periphery or external to the partitions 62*a* and 62*b* (the region between partition 62*a* and wall 65 and the region between partition 62*b* and wall 66 of recycle chamber 60) are referred to as recycle zones 61*a*. The region internal to the partitions 62 (the region between partitions 62*a* and 62*b*) and the region within conventional column sections 70, is referred to as the flotation or collection zone 71. The height of partitions 62 is less than the height of recycle chamber 60 and such partitions are positioned intermediate the upper and lower ends of recycle chamber 60. This intermediate positioning defines an entry or opening 61*b* above partitions 62*a* and 62*b* and below the upper end of recycle chamber 60 and also defines a similar opening or exit 61*c* below partitions 62*a* and 62*b* and above the lower end of recycle chamber 60. Entry 61*b* and exit 61*c* are areas of transition between flotation zone 71 and recycle zone 61*a*. The width of both recycle zones 61*a* within a recycle chamber 60 is preferably ten to fifty percent of the flotation zone 71**.

The problem of uneven air distribution is eliminated in the multiple recycle process and apparatus. Although unlikely, should uneven air occur at one point it would only affect a very small portion of the column 10 not the entire column 10 as it does in conventional columns where efforts are made to completely prevent mixing or recycle. Furthermore, the recycle in the various chambers 60 continuously mixes air with pulp. This eliminates the necessity of uniform aeration across the entire cross-sectional area as is the case with conventional columns. Surprisingly, multiple recycle chambers 60 yield metallurgy that is superior to conventional columns without such recycle.

Figure 7:
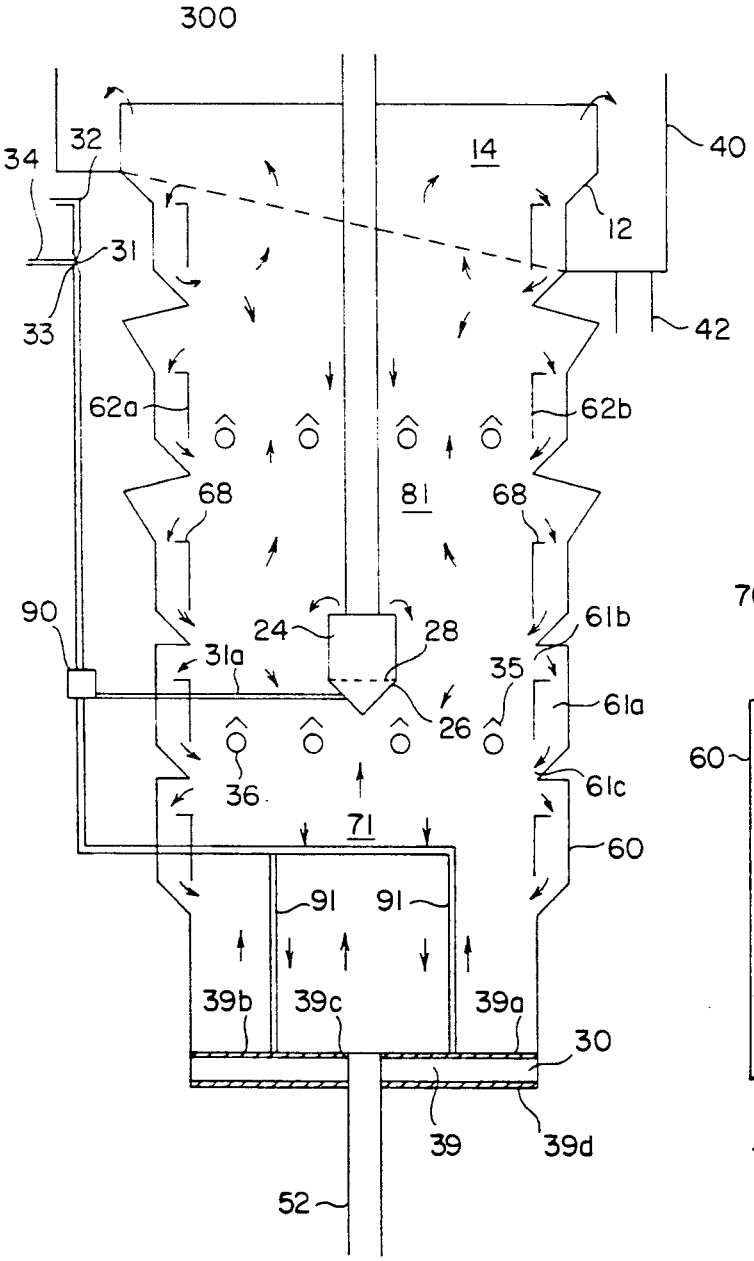
FIG. 7 is a schematic elevational view of another embodiment of the invention described herein.

FIG. 4 illustrates a preferred embodiment 100 of the invention which is similar to flotation column 10 except for the differences discussed below. A constriction compartment 39 as described in U.S. Pat. No. 4,431,531 and incorporated herein for all purposes is located at the lower end of flotation column 10. Eductor 31 introduces water and aerated air through orifices 39*a* formed in a top plate 39*b* of constriction compartment 39 in the form of a plurality of streams of uniformly aerated water. In this connection, it is important to note that the constriction compartment 39 is not an air diffuser and that the orifices 39*a* formed therein are not intended to control air bubble size or promote air diffusion, the stream of water flowing through each orifice 39*a* already being aerated with a multitude of minute, uniformly dispersed air bubbles The orifices 39*a* formed in the top plate 39*b* are distributed in a relatively widely spaced geometric pattern across the entire area of the top plate 39*b* in order to insure uniform distribution of the aerated water and, thereby, to insure uniform aeration of the aqueous pulp in the flotation column 100. By way of example, a typical top plate 39*b* is formed with orifices about 5/16th inch in diameter spaced apart on two or three inch centers, as contrasted with the multitude of minute, bubble-forming pores with which a diffuser of conventional design is formed When constriction compartments are used for distributing air, the non-float fraction of the pulp passes via bypass conduits 39*c* to underflow section 50. Bypass conduits 39*c* are distributed in a relatively widely spaced geometric pattern across the entire constriction compartment 39 and are attached to orifices (which are relatively large compared to orifices 39*a*) formed in top plate 39*b* and bottom plate 39*d*. Underflow section 50 is preferably tapered or conical to collect the underflow from the multiple bypass conduits 39*c*, however individual pipes (not shown) with valves could also be used to collect the underflow. As shown in FIG. 7, the non-float fraction can also be discharged through one hole or bypass conduit 39*c* through an air distributing constriction compartment.

A feed distributor 24 as described in U.S. Pat. Nos. 4,287,054 and 4,431,531 and incorporated herein for all purposes may be attached to the lower end of feeder line 20. As pulp flows out the lower end of feeder line 20 it will fill up feed distributor 24 and then overflow into the interior region of flotation column 100. Normally, the cone section 26 is a constriction compartment including a perforated plate 28 to which water and air are added via eductor line 31*a*. Water and air pass through the perforated top plate 28 thus fluidizing and aerating the incoming pulp. If desired, water alone can be used for fluidizing the pulp. If the flotation column is constructed with a round cross-sectional configuration, the feed distributor 24 would be round but if the flotation column is constructed with a square or rectangular cross-sectional configuration, the feed distributor 24 is preferably designed as a narrow rectangular trough running between walls 63 and 64.

Lower ends 67 of walls 65 and 66 are preferably inclined to create a more uniform flow within the recycle chamber 60 and to prevent the build up of pulp due to the force of gravity within a 45° corner.

Disengaging chambers 80 are preferably positioned in series above or in a downstream floatable fraction position from each recycle chamber 60. Disengaging chambers 80 are structured to have a larger cross-sectional area than the cross-sectional area of recycle chamber 60. Each disengaging chamber 80 preferably includes front walls and back walls (not shown) which are parallel to each other similar to walls 63 and 64 of flotation column 10 shown in FIG. 2 and include side walls such as tapered edges 82 and 84 on opposite sides. The front and back walls and tapered edges 82 and 84 of disengaging chamber 80 define a disengaging zone 81. Tapered edges 82 and 84 enhance mixing or non-vertical flow while discouraging build-up in corners within the disengaging zone 81. Because of the increase in the cross-sectional area, the movement of pulp through a disengaging zone 81 is slowed thus allowing non-floatable materials to drop out so that such materials can be sent to a lower stage or chamber within the flotation column 100.

In FIG. 4 the size of the flotation zone 71 is preferably five feet by five feet with an eighteen feet six inch flotation depth. The overall depth including the froth zone 14 and underflow section 50 is preferably twenty-two feet.

Figure 5:
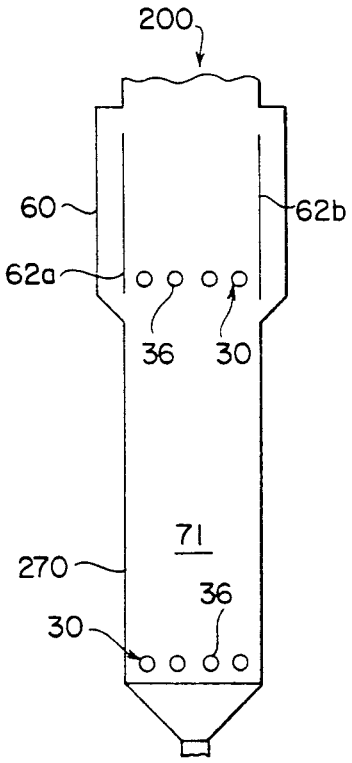
FIG. 5 is a schematic elevational view of another embodiment of the invention described herein incorporating a conventional flotation column section.

Referring to FIG. 5, the lower end of another embodiment of a flotation column 200 is shown. In this embodiment the lower end of the flotation column 200 is constructed with an extended conventional flotation column section 270. Extended conventional column sections 270 could also be placed at the upper end or at various intermediate positions of a recycle flotation column.

Referring back to FIGS. 1 and 4, the flotation zone 71 serves to connect recycle chambers 60 in series. The vertical and horizontal distance between recycle zones 61*a* will of course vary according to the characteristics of the materials being tested in order to take advantage of the optimum characteristics of the apparatus of this invention. The number and placement of disengaging zones 81 and their spacing from the recycle chambers 60 will vary as well. For example, a column 10 may have eight recycle chambers 60 and only four disengaging zones 81.

Figure 6:
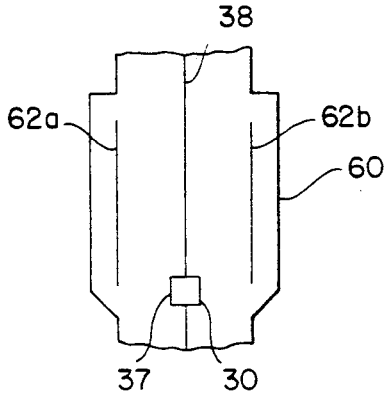
FIG. 6 is a schematic elevational view showing another embodiment of the invention described herein.

Referring to FIG. 6, a mechanical aerator 37 (shown schematically) connected by air line 38 is represented. Mechanical aerators 37 are generally not preferred although conditions may exist in which they can be beneficial.

Referring to FIG. 7, a flotation column 300 constructed without conventional flotation column sections 70 depicts the flow of the fluid through the flotation zone 71 and recycle zones 61*a*. Aeration pipes 36 or alternatively porous diffusers (not shown) which are connected through flotation column 300 may be placed at a variety of levels within the flotation column 300. These pipes 36 are preferably located proximate the lower end of the recycle chambers 60 within the flotation zone 71. More than one pipe 36 can be placed at any level within the flotation column 300 to increase the initial uniformity of aeration within the flotation column 300. For example, four pipes are shown at each of two different levels in FIG. 7. For large commercial columns it would not be unusual to use twenty or more pipes at each level. Shields 35 are optional and if used are positioned over the pipes 36. The lower ends of shields 35 should not extend below the level of the top of pipes 36.

In one embodiment utilizing an eductor 31, water is introduced at forty to sixty pounds per square inch into a three inch running water line 32 and then introduced into a four inch eductor 31. The aspirated mixture is run through a four inch pipe into a distributor box 90. A one and one half inch pipe 31*a* runs from distributor box 90 to feed distributor 24. Four separate two inch pipes 91 run from distributor box 90 to constriction compartment 39. Other embodiments utilizing an eductor 31 can be designed by one skilled in the art.

Recycle rates can be controlled by varying air, by varying the width of recycle zone 61*a*, or preferably it is controlled by the size of openings 61*b* and 61*c* to and from the recycle zones 61*a*. Restriction plates 68 are a preferred embodiment to be used for such control. Restriction plates 68 are attached to opposing walls 63 and 64 and positioned to partially restrict the entries 61*b* to the recycle zones 61*a*. As shown, these restriction plates 68 are preferably horizontally disposed and abut partitions 62 although they may be positioned in other manners which would restrict the flow through the recycle zones 61*a*. Since restriction plates 68 restrict the flow through recycle zones 61*a*, they impede or slow down the recycle rate of a recycle chamber 60. Hence, different sized restriction plates 68 can be designed to control the recycle rate within any recycle chamber 60.

Figure 8:
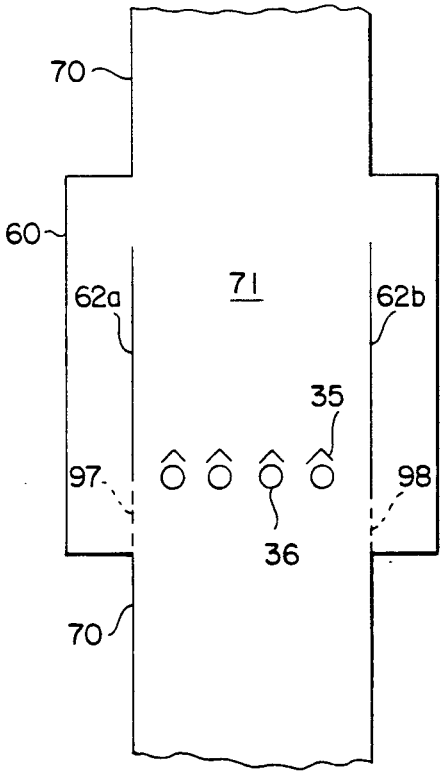
FIG. 8 is a schematic elevational view of a recycle chamber utilizing baffles.

FIG. 8 shows another optional feature which may be added within a recycle chamber 60. Baffles 97 can be added to cover the exits of the recycle zones 61*a* to dislodge gangue that is attached to the mineral. The baffle 97 is preferably constructed of a perforated plate 98. However, baffle 97 could also be constructed from a series of parallel, vertically or horizontally, disposed bars (not shown).

Frother type reagents which are used in conventional columns are also used in the recycle flotation column for forming fine bubbles. Some examples of reagents which can be used in the recycle flotation column are as follows: F-507 which is a mixed polyglycol; alcohols, such as methyl amyl alcohol, methyl isobutyl alcohol, etc., generally $C_5$ to $C_{16}$; mixed alcohols, generally $C_4$ to $C_{16}$ (generally the composition is such that several other oxygenated compounds makeup the mixture; often referred to as distillation bottoms); polyglycol ethers (common examples are polypropylene glycol, methyl ether, 250 to 400 molecular weight). All of the reagents have varying degrees of effectiveness. Some reagents may be more cost effective, some will provide better metallurgical results, i.e. concentrate grade and percent recovery (yield).

A column seven feet high and about four×four inches with one inch wide recycle zones 61*a* on opposite sides has been utilized as a test unit. It was used in the following examples, offered for the purposes of illustration and not limitation. These examples show the marked advantages of using a series of internal recycle zones in the beneficiation of ores.

FIG. 1 illustrates this test unit or original lab pilot plant. Four stages of recycle are shown. An eductor 31 is used at the lower end to generate fine bubbles for flotation. A constriction compartment (not shown) similar to the constriction compartment 39 shown in FIG. 4 has also be used. An air diffuser (not shown) has been installed near the lower end and another (not shown) about one-third the way down. This allows testing of the eductor alone, air diffusers alone or a combination of the two aeration systems.

EXAMPLE 1

A phosphate flotation feed taken from a Florida Phosphate Plant was used as the flotation feed (mostly 14×100 mesh) and was conditioned at high solids (about 70%) for 90 seconds using fuel oil, fatty acid (such as fatty acid sold under the mark "PAMAK" by Hercules or distilled tall oil, straight chain $C_{18}$ mono and di-unsaturated fatty acid) and ammonia as reagents. Conditioned feed was divided into two parts. One part was floated in a standard commercially available laboratory test column (Flotaire) and the other part was floated in the recycle column of this invention. Following is a brief resume of results:

| Reagents | Lbs/Ton Feed |
|---|---|
| Fuel oil | 0.40 |
| Fatty Acid | 0.40 |
| $NH_3$ | 0.33 |
| Recycle Column | |
| Feed, BPL-(bone phosphate of lime or essentially tricalcium phosphate) | 32.19 |
| Concentrate, BPL | 71.37 |
| Concentrate, Insol. | 4.67 |
| Tails, BPL | 9.60 |
| % BPL Recovery | 81.1 |
| Flotaire Column | |
| Feed, BPL | 32.19 |
| Concentrate, BPL | 69.33 |
| Concentrate, Insol. | 6.51 |
| Tails, BPL | 15.03 |
| % BPL Recovery | 68.1 |

EXAMPLE 2

Using both coarse and fine phosphate flotation feeds that were difficult to obtain a good grade product, a comparison was made between a conventional laboratory column and the laboratory recycle column (see FIG. 1). The feed material comprised essentially mixtures of phosphate rock and silica particles. Feeds were conditioned at about 70% solids using a fatty acid, fuel oil and ammonium hydroxide. The particle size of the coarse feed was mostly between 14 mesh and 65 mesh (Tyler Standard) and the fine feed was mostly between 35 mesh and 200 mesh.

| | |
|---|---|
| Coarse Feed | |
| Recycle Column | |
| Concentrate, BPL | 64.95 |
| Concentrate, Insol. | 13.56 |
| % BPL Recovery | 99 |
| Conventional Column | |
| Concentrate, BPL | 53.44 |
| Concentrate, Insol. | 28.57 |
| % BPL Recovery | 97 |
| Fine Feed | |
| Recycle Column | |
| Concentrate, BPL | 67.01 |
| Concentrate, Insol. | 10.65 |
| % BPL Recovery | 93 |
| Conventional Column | |
| Concentrate, BPL | 41.81 |
| Concentrate, Insol. | 44.16 |
| % BPL Recovery | 93 |

The grade of products from the recycle column are high enough to be used in a phosphate chemical processing plant, but products from the conventional column need further beneficiation before going to the chemical processing plant.

EXAMPLE 3

Coal test results are as follows:

| | |
|---|---|
| Feed | |
| % Ash | 13.21 |
| Froth (Conc.) | |
| % Ash | 5.87 |
| % BTU Recovery | 90.49 |
| Tails | |
| % Ash | 47.63 |

Feed was -100 mesh material. F-507 was used as the reagent or collector and lime was used as modifier (raise pH)

EXAMPLE 4

A Spodumene rougher flotation concentrate from a plant in North Carolina was used as the feed for the test. The spodumene rougher flotation concentrate presently undergoes two stages of cleaner flotation in the plant for upgrading. The plant data obtained from two stages in series of cleaner flotation is compared to one stage of cleaning in the test recycle column:

| | |
|---|---|
| Recycle Column | |
| % $Li_2O$, Concentrate | 5.38 |
| % $Li_2O$, Recovery | 92.1 |
| Plant | |
| % $Li_2O$, Concentrate | 5.17 |
| % $Li_2O$, Recovery | 91.0 |

EXAMPLE 5

Tailings (mostly sand) from a spodumene flotation plant in North Carolina was used as the feed for the test. The tailings feed was conditioned at high solids with reagents and was subjected to flotation to remove iron and residual spodumene to produce a high grade sand product. A comparison was made between the plant flotation column and the recycle test column:

| | |
|---|---|
| Recycle Column | |
| Tailing, % $Li_2O$ | 0.02 |
| Tailing, % $Fe_2O_3$ | 0.022 |
| Recovery, % $Li_2O$ | 94.0 |
| Recovery, % $Fe_2O_3$ | 78.3 |
| Plant Column | |
| Tailing, % $Li_2O$ | 0.15 |
| Tailing, % $Fe_2O_3$ | 0.035 |
| Recovery, % $Li_2O$ | 68.0 |
| Recovery, % $Fe_2O_3$ | 57.3 |

It is to be appreciated that the invention described above can be constructed with a square, rectangular or circular cross-section implementing the recycle chamber and disengaging chamber concepts described. The same recycle and disengaging principles as shown and disclosed in the rectangular column represented in the drawings with modified construction can be applied to square and circular recycle columns. Partitions 62, and hence recycle zones 61*a*, could be staggered within the flotation column. In a square or rectangular cross-sectional configuration, partitions 62 could also be located on all four sides creating four recycle zones 61*a* per recycle chamber 60. It is not essential that partitions 62 be vertically aligned with the walls of conventional column sections 70. Attachments or connections made to construct the invention are preferably made by welding although fasteners, adhesives or other known methods of attachment can be used.

The preferred embodiment of the invention has been shown and described above. It is to be understood that minor changes in the details, construction and arrangement of the parts may be made without departing from the spirit or scope of the invention as described and claimed.

I claim:

1. Apparatus for effecting concentration of minerals by froth flotation of a pulp containing a mixture of mineral particles and gangue particles comprising:

a flotation column for receiving the pulp for generally vertical flow of said pulp in said column, at least two vertically spaced separate recycle chambers disposed along the length of said flotation column with each recycle chamber being defined between said column and a vertically extending partition wall which is spaced a distance inwardly of said column, said column defining a columnar flow area inwardly of said recycle chambers, each partition wall further defining a lateral inlet between said column and the upper end of each partition wall and a lateral outlet between said partition wall and the column thereby to separate columnar flow from recycle chamber flow, said column having a portion between said at least two vertically spaced separate recycle chambers that extends inwardly substantially the same distance that each partition wall is spaced from the column whereby recycle pulp is delivered back into the columnar flow from an upper recycle chamber prior to any further recycle thereof in a lower recycle chamber, pulp feed means for introducing the pulp into the flotation column, froth overflow means disposed adjacent the upper end of said flotation column for discharging a froth float fraction of the pulp, underflow discharge means disposed adjacent the lower end of said column for discharging therefrom a non-float fraction of the pulp, and, aeration means disposed in said column for generating bubbles of gas to separate said float and non-float fractions of said pulp, whereby pulp subjected to aeration treatment in said flotation column has a plurality of portions thereof subjected to recycle flow in said recycle chambers apart from said flotation column thereby to enhance recovery of float and non-float fractions.

2. The apparatus according to claim 1, wherein said recycle chambers further include a disengaging baffle located over at least one of the lateral outlets.

3. The apparatus according to claim 2, wherein said disengaging baffle comprises a perforated plate.

4. The apparatus according to claim 1, further including a restriction plate positioned in the recycle zone whereby the area of said recycle zone is decreased thereby decreasing the rate of recycle within said recycle chambers.

5. The apparatus according to claim 1, further comprising a means for disengaging the movement of the pulp attached in series above at least one of said recycle chambers for accentuating the dropout of the non-float fraction containing unfloated particles.

6. The apparatus according to claim 5, wherein said disengaging means comprises a disengaging chamber which defines a disengaging zone having a greater cross-sectional area than the cross-sectional area of said recycle chambers to slow the flow of the pulp thereby allowing non-float fraction to drop from the mixture.

7. The apparatus according to claim 6, wherein said disengaging chamber includes at least two non-vertically aligned walls to promote mixing and the movement of the float fraction containing floated particles in an upward direction and to promote the movement of the non-float fraction in a downward direction.

8. The apparatus according to claim 1, wherein said aeration means comprises an eductor using driven water to aspirate air into a gas diffuser, said gas diffuser including a means for uniform gas distribution on a portion of said gas diffuser disposed within the flotation column.

9. The apparatus according to claim 8, wherein said uniform gas distribution means comprises a porous tube.

10. The apparatus according to claim 8, wherein said flotation column includes a horizontally disposed shield located above said gas diffuser.

11. The apparatus according to claim 1, wherein said aeration means comprises a constriction compartment.

12. The apparatus according to claim 1, wherein said aeration means comprises a plurality of gas diffusers including a uniform gas distribution means horizontally disposed within and proximate a lower end of said recycle chambers.

13. The apparatus according to claim 1, wherein the upper end of said flotation column is flared to slow the flow of the pulp adjacent the upper end of the flotation column thereby allowing remaining non-float fraction containing unfloated particles to drop from the mixture.

14. Apparatus for effecting concentration of minerals by froth flotation of a pulp containing a mixture of mineral particles and gangue particles comprising:

a flotation column for receiving the pulp for generally vertical flow of said pulp in said column, at least two vertically spaced separate recycle chambers disposed along the length of said floatation column with each recycle chamber being defined between said column and a vertically extending partition wall which is spaced inwardly of said column, said column defining a columnar flow inwardly of said recycle chambers, each partition wall further defining a lateral inlet between said column and the upper end of each partition wall and a lateral outlet between said partition wall and the column thereby to separate columnar flow from recycle chamber flow, said flotation column further having means defining a plurality of disengaging chambers adjacent the recycle chamber inlets each chamber defining a disengaging zone of greater cross-sectional area than the cross-sectional area of each of said recycle chambers to slow the flow of pulp thereby allowing non-float fractions to drop from the pulp mixture, said disengaging chambers being disposed in series above said recycle chambers, pulp feed means for introducing the pulp into the flotation column, froth overflow means disposed adjacent the upper end of said flotation column for discharging a froth float fraction of the pulp, underflow discharge means disposed adjacent the lower end of said column for discharging therefrom a non-float fraction of the pulp, and, aeration means disposed in said column for generating bubbles of gas to separate said float and non-float fractions of said pulp, whereby pulp subjected to aeration treatment in said flotation column has a plurality of portions thereof subjected to recycle flow in said recycle chambers apart from said flotation column thereby to enhance recovery of float and non-float fractions.

* * * * *